United States Patent [19]

Fujii

[11] 4,251,827

[45] Feb. 17, 1981

[54] WET TYPE DIRECT RECORDING METHOD

[75] Inventor: Tadashi Fujii, Yokohama, Japan

[73] Assignee: Ricoh Company, Ltd., Japan

[21] Appl. No.: 969,687

[22] Filed: Dec. 14, 1978

[30] Foreign Application Priority Data

Dec. 15, 1977 [JP] Japan ..... 52-151135

[51] Int. Cl.[3] ..... G03G 13/00

[52] U.S. Cl. ..... 346/165; 346/153.1; 340/783

[58] Field of Search ..... 346/153, 155, 157, 165, 346/74.1; 340/783, 787, 788

[56] References Cited

U.S. PATENT DOCUMENTS

| | | | |
|---|---|---|---|
| 3,292,171 | 12/1966 | Wilson | 340/787 |
| 3,648,269 | 3/1972 | Rosenzweig | 340/788 |
| 3,654,095 | 4/1972 | Koontz et al. | 346/165 |
| 3,786,515 | 1/1974 | Walker | 346/165 |
| 3,863,249 | 1/1975 | Olah | 340/788 |
| 3,866,236 | 2/1975 | Goffe | 346/153 |
| 3,872,480 | 3/1975 | Engelbrecht | 346/153 |
| 4,097,637 | 6/1978 | Loria et al. | 346/153 |

*Primary Examiner*—Marshall M. Curtis
*Attorney, Agent, or Firm*—McGlew and Tuttle

[57] ABSTRACT

The wet type direct recording method and apparatus is disclosed in which a liquid oil phase is formed in advance on the surface of a recording sheet, and the oil phase is then brought into contact with the aqueous phase comprising an aqueous colored liquid, and a signal voltage containing a recording image information is applied to the interface between the oil phase and the aqueous phase and an electrically emulsified pattern, which corresponds to the recording image formation, is formed on the surface of the recording material, so that a recording image of the aqueous colored liquid is obtained.

14 Claims, 3 Drawing Figures

WET TYPE DIRECT RECORDING METHOD

BACKGROUND OF THE INVENTION

The present invention relates to an improved wet type direct recording method.

DESCRIPTION OF THE PRIOR ART

Conventionally, as the method for forming an image directly on a recording material, a method called contrography is known. Referring to FIG. 1, in this method, a recording electrode B is brought into contact with one side of a recording material A, and to the other side of the recording material A, a liquid developer D is supplied by a development roller C and at the same time, a signal voltage is applied to the recording electrode B, so that charged toner particles dispersed in the liquid developer D are moved and deposited on the recording material A. Thus, a recording image is obtained. This method is simple since application of the signal voltage and development of the image are performed at the same time. Furthermore, since the recording image formation surface is on the opposite side of the recording electrode contacting surface, it is suitable for color recording process in which charging and development are repeated on the same recording material.

However, this method has a disadvantage that the background of the recording material is smeared by the liquid developer since the recording material is wetted with the liquid developer. The background can be reduced to a certain extent by reducing the content of the toner in the liquid developer. However, this brings about lowering of the image density. Furthermore, since the toner particles in the liquid developer are moved by electrophoresis, the toner particles move slowly. Accordingly the recording speed of this method is limited, so that this method cannot meet sufficiently a demand for a high speed recording.

SUMMARY OF THE INVENTION

It is therefore a primary object of the present invention to provide an improved wet type direct recording method which has eliminated the above-mentioned disadvantages of the conventional method.

When two immiscible liquids, such as an oil phase and an aqueous phase, are brought into contact with each other and a polarized voltage is applied to the interface between the two liquids, the interfacial tensions of the two liquids are changed. This phenomenon is called electric capillarity. When the interfacial tensions of the oil phase and the aqueous phase are reduced considerably by causing the electric capillarity phenomenon to occur sufficiently, the two liquids are emulsified. Hereafter, this emulsifying phenomenon is called electric emulsification. In the present invention, this electric emulsification is employed. To be more specific, in the present invention, an oil phase is formed in advance on the surface of a recording sheet. The oil phase is then brought into contact with an aqueous phase comprising an aqueous colored liquid, and a signal voltage containing a recording image information is applied to the interface between the oil phase and the aqueous phase and an electrically emulsified pattern which corresponds to the recording image information is formed on the surface of the recording material, so that a recording image of the aqueous colored liquid is obtained.

According to the present invention, an image fixing process can be omitted since the recording method is of a wet type. Furthermore, plain paper or recording materials similar to plain paper can be employed as the recording material in the present invention. Sitll furthermore, in comparison with the conventional contrography, images of a higher image density can be recorded at a higher speed and high quality recording images with almost no background can be obtained.

DETAILED DESCRIPTION OF THE PREFERRED EMBODIMENT

Figure 1:
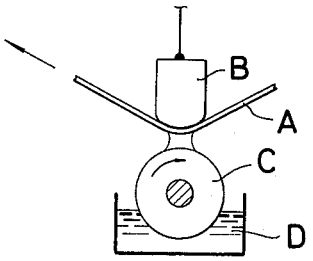
FIG. 1 is a schematic sectional view of a conventional recording apparatus of contrography.
Figure 2:
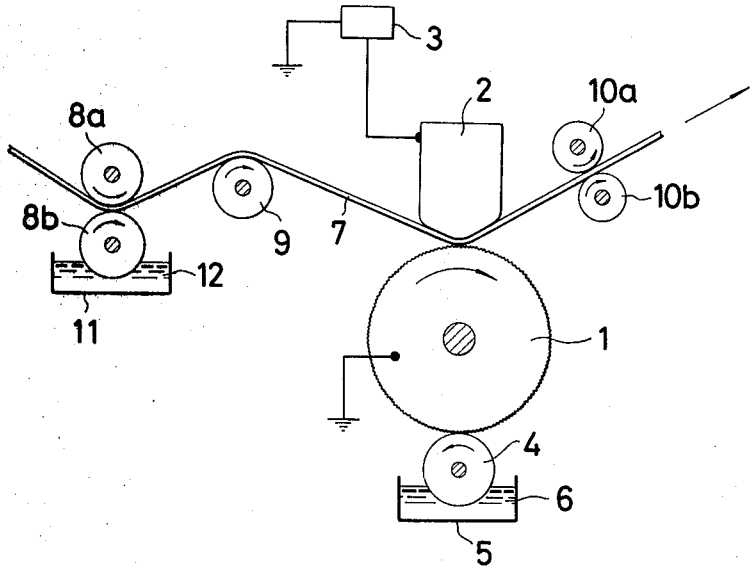
FIG. 2 is a schematic sectional view of a recording apparatus according to the present invention.

Referring to FIG. 2, reference numeral 1 represents a drum-shaped counter electrode which faces a recording electrode 2 and which is rotatable in the direction of the arrow. When recording is made, a voltage which is varied in accordance with an image information to be recorded is applied to the recording electrode 2 by a signal generation source 3, so that an electric field for recording is produced between the counter electrode 1 and the recording electrode 2. A roller 4 is in pressure contact with a lower portion of the counter electrode 1. A lower half portion of the roller 4 is immersed in an aqueous colored liquid 6 in a tank 5.

Between the counter electrode 1 and the recording electrode 2, there is placed a recording sheet 7, such as plain paper, dielectric film, electrostatic recording film, and cloth. To the recording sheet 7, there is applied an appropriate tension by a pair of rollers **8*a* and 8*b*, a support roller 9 and a pair of rollers 10*a* and 10*b*. The recording sheet 7 is transported in the direction of the arrow as the counter electrode 1 is rotated while one side of the recording sheet 7 slides on an end surface of the recording electrode 2. In the present embodiment, as viewed from the transporting direction of the recording sheet 7, the rollers 8*a* and 8*b* are positioned upstream of the support roller 9, and the recording electrode 2 is positioned downstream of the support roller 9 and upstream of the rollers 10*a* and 10*b*. Thus, the recording sheet 7 passes between the rollers 8*a* and 8*b* and over the support roller 9 and between the counter electrode 1 and the recording electrode 2. A lower half of the roller 8*b* which is the lower counterpart of the roller 8*a* is immersed in an oily liquid 12 in a tank 11**.

Figure 3:
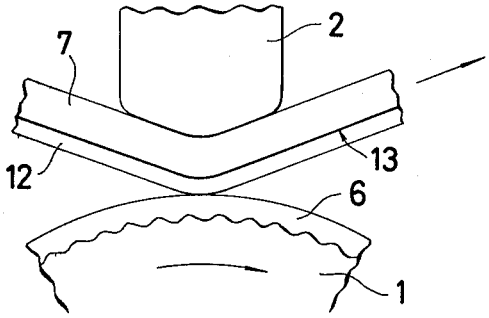
FIG. 3 is a partially enlarged view of FIG. 2.

During a recording image formation, the recording sheet 7 is moved in the direction of the arrow, and the oily liquid 12 is applied to a contact surface of the recording sheet 7 which is in contact with the roller **8*b* (hereafter referred to as a treated surface 13, refer to FIG. 3) by the roller 8*b* before the recording sheet 7 passes over the recording electrode 2. The peripheral surface of the counter electrode 1 is coated with the aqueous colored liquid 6 and as the recording sheet 7 is moved in the direction of the arrow, the treated surface 13 of the recording sheet 7 is brought into contact with the counter electrode 1 at a portion where the counter electrode 1 and the recording electrode 2 face each other. At this time, since the peripheral surface of the counter electrode 1 is coated with the aqueous colored liquid 6, the oily liquid 12 on the treated surface 13 comes in contact with the aqueous colored liquid 6. And a recording electric field which is varied in accordance with a recording image information is produced between the counter electrode 1 and the recording electrode 2 by a signal voltage generated from the signal generation source 3, the surface tension of the oily liquid 12 on the treated surface 13 and that of the aqueous colored liquid 6 on the counter electrode 1 are changed in accordance with the variation of the recording electric field. As a result, the mixed liquids are electrically emulsified, so that a recording image is formed by the aqueous colored liquid 6 on the treated surface 13**.

As the oily liquid 12 and the aqueous colored liquid 6, such liquids are chosen as are not miscible with each other unless an electric field is applied to the interface between the two liquids. Forming very fine undulations on the peripheral surface of the counter electrode is effective for facilitating the supply of the aqueous colored liquid 6 to the counter electrode 1 and coating of the liquid 6 on the counter electrode 1. Such undulations can be formed by machinery process, chemical etching process, and electric surface treatment process or the like. As the aqueous colored liquid 6, for example, an aqueous solution of a dye can be used. In this case, polyethylene glycol may be added to the solution in order to prevent the solution from becoming dry hard.

In the present invention, in order to obtain a high image density at a high speed by the application of a comparatively low signal voltage, it is necessary to cause the electric emulsification to occur efficiently at the interface between the oily liquid 12 and the aqueous solution 6. Furthermore, it is necessary that the emulsion state be maintained stably. In order to attain this, the following conditions will be also necessary.

1. As the solvents for use in the oily liquid 12, methyl isobutyl ketone, nitrobenzene, carbon tetrachloride, petroleum solvents, such as Isopar G and Isopar H, can be used. Furthermore, it is preferable to add at least one electrolyte or one surface active agent to the oily liquid 12. As the electrolytes for use with the liquid 12, cetyl pyridinium chloride, tetrabutylammonium chloride, dodecyl sodium sulfate, and di-(2-ethyl.hexyl) sodium sulfosuccinate can be employed, and as the surface active agent for use with the oily liquid 12, polyoxyethylene nonylphenol ether and sorbitan monooleate can be employed.
2. It is preferable to add an surface active agent to either of the oily liquid 12 and the aqueous colored liquid 6.
3. It is preferable to add an electrolyte to the aqueous colored liquid 6. The electrolyte for use with the aqueous colored liquid 6 is the so-called builder. The addition of the electrolyte is intended to bring about the effect of the builder, which thereby can reduce the interfacial tensions of the oily liquid 12 and the aqueous colored liquid 6, so that the electric emulsification can be readily caused to occur.

The following are the experiments conducted by use of the apparatus as shown in FIG. 2.

EXPERIMENT 1

As the oily liquid 12, a methyl isobutylketone solution of polyoxyethylene nonylphenol ether (concentration 0.5 wt%) was employed, and as the aqueous colored liquid 6, an aqueous solution of sodium laurate (concentration $10^{-2}$ mole/l) and Naphthol Blue Black Dye (concentration 1.0 wt%) was employed. As the recording sheet 7, plain paper was employed. By applying a signal voltage with D.C. −600 V of signal pulse voltage and 200μ sec of pulse width to the recording electrode 2, image recording was performed. As a result, a clear and excellent image of Naphthol Blue Black dye was obtained.

EXPERIMENT 2

As the oily liquid 12, a nitrobenzene solution of sorbitan monooleate (concentration 0.3 wt%) and cetyl pyridinium chloride (concentration $10^{-4}$ M) was employed. As the aqueous colored liquid 6, an aqueous solution of sodium laurate (concentration $10^{-2}$ M) and sodium chloride (concentration $5\times10^{-3}$ M) and Methyl Orange Dye (concentration 0.7 wt%) was employed. As the recording sheet 7, plain paper was employed. By applying a signal voltage with AC 400 V of signal pulse voltage and with 300μ sec of signal pulse width to the recording electrode 2, a clear and excellent image of Methyl Orange Dye was obtained.

What is claimed is:

1. A wet type direct recording method comprising the steps of:

applying an aqueous colored liquid to a counter electrode which is disposed so as to face a recording electrode with a predetermined gap therebetween, passing a recording material which is coated with or soaked with an oily liquid between said counter electrode and said recording electrode with the oily liquid coated or soaked side of said recording material being in contact with the surface of said counter electrode, applying a recording electric field corresponding to a recording image information to be recorded on said recording material to said counter electrode and said recording electrode, whereby the interfacial tensions of said oily liquid and said aqueous colored liquid on said recording electrode are changed to emulsify said two liquids electrically and a recording image of said aqueous colored liquid is formed on said recording material.

2. A wet type direct recording method as claimed in claim 1, wherein said recording material is one material selected from the group consisting of plain paper, dielectric film, electrostatic recording paper and cloth.

3. A wet type direct recording method as claimed in claim 1, wherein said oily liquid comprises one solvent selected from the group consisting of methyl isobutyl ketone, nitrobenzene, carbon tetrachloride and petroleum solvents.

4. A wet type direct recording method as claimed in claim 1, wherein said aqueous colored liquid comprises a solution of sodium laurate and Naphthol Blue Black Dye.

5. A wet type direct recording method as claimed in claim 1, wherein said aqueous colored liquid comprises an aqueous solution of sodium laurate, sodium chloride and Methyl Orange Dye.

6. A wet type direct recording method as claimed in claim 3, wherein said oily liquid further contains an electrolyte or a surface active agent.

7. A method of recording an image on a receiving sheet, comprising wetting a surface of the sheet with an oily liquid, directing an aqueous colored liquid to said surface, and applying a recording electric field corresponding to the image to be recorded to said surface so as to produce interfacial tensions between the oily liquid and the aqueous colored liquid and to emulsify said liquids electrically, whereby to form a recording image of said aqueous colored liquid on said surface.

8. A method according to claim 7, including moving said sheet while wetting the surface with the oily liquid, and wherein the recording electric field is applied by a recording electrode which is connected to a signal generating source to produce the image and which is arranged on one side of the sheet and with a counter electrode arranged on the opposite side of the sheet and including applying the aqueous colored liquid to the counter electrode for transfer to the opposite side of the sheet which has previously received the oily liquid.

9. An apparatus for recording an image on a receiving sheet, comprising first applicator means adjacent the sheet for applying an oily liquid to said sheet, second applicator means adjacent the sheet for applying an aqueous colored liquid to said sheet, and recording electric field means acting on said sheet at a location which has received both the aqueous colored liquid and the oily liquid and producing interfacial tension between said aqueous colored liquid and said oily liquid to emulsify them and to form a recording image of the aqueous colored liquid on said sheet.

10. An apparatus according to claim 9 wherein said first applicator means comprises an oily liquid reservoir and roller means in said reservoir for picking up the oily liquid and transferring it to said sheet and including means for moving said sheet past said roller means.

11. An apparatus according to claim 10 wherein said second applicator means comprises a reservoir of aqueous colored liquid, a rotatable counter electrode comprising a part of said recording electric field means, and means for transferring the aqueous colored liquid to the surface of said counter electrode, and further including a recording electrode disposed opposite said counter electrode and adjacent said sheet also comprising a portion of said recording electric field means.

12. An apparatus for recording an image on a receiving sheet comprising means for feeding said sheet through a feed path, an oily liquid reservoir adjacent said feed path roller means engageable in said reservoir and with said sheet for transferring said oily liquid to one side of said sheet, a rotatable counter electrode drum engageable with said one side of said sheet as it is advanced, an aqueous colored liquid reservoir, a roller engaged in said aqueous liquid colored reservoir and with said counter electrode drum for distributing aqueous colored liquid to the surface of said drum and from the surface of said drum to said sheet, a recording electrode disposed on the opposite side of said sheet from said counter electrode drum, signal generating source means connected to sid recording electrode for applying a recording electric field to said sheet at the location where the aqueous colored liquid is applied over said oily liquid.

13. An apparatus according to claim 12, wherein said oily liquid comprises a methyl isobutyl ketone solution of polyoxyethylene nonylphenol ether (concentration 0.5 wt%) and the aqueous colored liquid comprises an aqueous solution of a sodium laurate (concentration $10^{-2}$ mole/l) and Naphthol Blue Black Dye (concentration 1.0 wt%).

14. An apparatus according to claim 12, wherein aid oily liquid comprises a nitrobenzene solution of sorbitan monooleate (concentration 0.3 wt%) and cetyl pyridinium chloride (concentration $10^{-4}$ M) and wherein the aqueous colored liquid comprises an aqueous solution of sodium laurate (concentration $10^{-2}$ M) and sodium chloride (concentration $5\times10^{-3}$ M) and Methyl Orange Dye (concentration 0.7 wt%).

* * * * *